US012486837B2

(12) United States Patent
Trump et al.

(10) Patent No.: US 12,486,837 B2
(45) Date of Patent: Dec. 2, 2025

(54) PERISTALTIC PUMP CASSETTE ARRANGEMENT USING MULTIPLE TUBES AND A PRESSURE PLATE

(71) Applicant: STRATEC SE, Birkenfeld (DE)

(72) Inventors: Martin Trump, Birkenfeld (DE); Marek Urbanczyk, Birkenfeld (DE); Volker Barenthin, Birkenfeld (DE)

(73) Assignee: STRATEC SE, Birkenfeld (DE)

( * ) Notice: Subject to any disclaimer, the term of this patent is extended or adjusted under 35 U.S.C. 154(b) by 30 days.

(21) Appl. No.: 18/418,550

(22) Filed: Jan. 22, 2024

(65) Prior Publication Data

US 2024/0287978 A1 Aug. 29, 2024

(30) Foreign Application Priority Data

Jan. 20, 2023 (LU) ..... 103064

(51) Int. Cl.
*F04B 43/12* (2006.01)

(52) U.S. Cl.
CPC ..... *F04B 43/1284* (2013.01); *F04B 43/1253* (2013.01)

(58) Field of Classification Search
CPC ..... F04B 43/1284; F04B 43/1253
See application file for complete search history.

(56) References Cited

U.S. PATENT DOCUMENTS 3,740,173 A * 6/1973 Natelson ..... F04B 43/1284 101/365
4,678,409 A * 7/1987 Kurokawa ..... F04D 13/024 417/420
5,261,793 A * 11/1993 Piltingsrud ..... F04B 43/1253 417/205
5,356,267 A * 10/1994 Fulmer ..... F04B 43/1253 417/477.1
5,447,417 A 9/1995 Kuhl et al.
5,846,061 A 12/1998 Ledebuhr et al.
2005/0019185 A1* 1/2005 Otis, Jr. ..... F04B 43/1253 417/477.3
2005/0047946 A1 3/2005 Davis et al.
2007/0183913 A1* 8/2007 Voyeux ..... F04B 43/1276 417/477.2
2007/0212240 A1 9/2007 Voyeux et al.
(Continued)

FOREIGN PATENT DOCUMENTS

CN 109372731 A * 2/2019 ..... F04B 43/1253
EP 2682605 A1 1/2014

*Primary Examiner* — Nathan C Zollinger
(74) *Attorney, Agent, or Firm* — William Gray Mitchell

(57) ABSTRACT

A peristaltic pump having a motor with a motor axis, a cassette with a rotor connected to the motor axis and a plurality of rollers, a tube partially surrounding the rotor between the rollers and a pressure plate mounted to a side wall, a spring between the pressure plate and a cover for applying a force to the pressure plate against the tube, and guiding ribs on an inner surface of the pressure plate facing the tube on both sides. The tube has a first end connected to a first vertical tube connector of a first external connector on one side of the rotor and a second end to a second vertical tube connector of a second external connector on the opposite side of the rotor. The first and second vertical tube connectors are connected to a connecting tube of a bridge providing at least one outlet.

13 Claims, 11 Drawing Sheets

(56) References Cited

U.S. PATENT DOCUMENTS

| | | | | |
|---|---|---|---|---|
| 2008/0085200 | A1* | 4/2008 | Michels | F04B 43/1253 417/477.1 |
| 2009/0285706 | A1 | 11/2009 | Bunoz | |
| 2011/0033318 | A1 | 2/2011 | Ramirez et al. | |
| 2017/0184088 | A1* | 6/2017 | Macari | F04B 43/1292 |
| 2020/0062573 | A1 | 2/2020 | Suzuki et al. | |
| 2022/0205443 | A1 | 6/2022 | Gledhill et al. | |
| 2022/0258158 | A1 | 8/2022 | Niemeyer et al. | |
| 2022/0260069 | A1* | 8/2022 | Van Stell | F04B 53/22 |

* cited by examiner

A

B

C

PERISTALTIC PUMP CASSETTE ARRANGEMENT USING MULTIPLE TUBES AND A PRESSURE PLATE

CROSS-REFERENCE TO RELATED APPLICATIONS

The present invention claims priority to national Luxembourg patent application No. LU 103064 filed on Jan. 20, 2023. The aforementioned application is incorporated herein by reference.

BACKGROUND OF THE INVENTION

Field of the Invention

The present disclosure relates to a peristaltic pump cassette arrangement using multiple tubes and a pressure plate.

Brief Description of the Related Art

Automated analyser systems for use in clinical diagnostics and life sciences are produced by a number of companies. For example, STRATEC® SE, Birkenfeld, Germany, produces a number of devices for specimen handling and detection for use in automated analyser systems and other laboratory instrumentation.

Different liquids are used during analytical assay in such analytical systems. Liquid waste results from the processing of samples with which have to be removed from the system, e.g. by pumps. Usually, the liquids are inhomogeneous and represent thus a potential risk for many pump technologies. As a result, the pumps wear out very quickly, which leads to increased maintenance effort and thus higher costs. In addition, potential leakage increases the risk of contamination in the unit.

Various pump technologies are commonly known from the prior art comprising gear pumps, diaphragm pumps, piston pumps, and peristaltic pumps. Many pump types are often unsatisfactory in terms of fault susceptibility.

Common faults are caused by deposits in the pump head and thus an insufficient delivery rate, pressure or lack of backflow resistance up to a complete failure of the pump. These faults can occur when pumping liquids that are corrosive, tend to precipitate or flocculate, contain particles or tend to deposit or stick together.

A backflow of liquid waste through the pump is a potential contamination risk for the patient sample and would negatively influence running assays so that they must be prevented at all costs.

Sticking or clogging of the valves by e.g. particles (blood, stool, etc. . . . ) in the liquid or by proteins or other sticky components from the patient samples and/or the reagents represent a risk for pump failure when using piston pumps or diaphragm pumps. Gearbox or gear pumps are basically very robust, but they have no backflow-proof.

In peristaltic pumps, the peristaltic hose is subject to increased wear due to the pump working principle and they must be replaced regularly as part of maintenance intervals. Since an incorrectly inserted hose can lead to a pump malfunction or loss of backflow resistance, this is a critical step. Therefore, hose replacement is reserved for a trained service technician. Nevertheless, errors can also occur here, which in the worst case can affect the running analysis. The present invention is intended to prevent pump errors.

SUMMARY OF THE INVENTION

It is therefore the object of this invention to provide an improved peristaltic pump regarding durability and usability or misuse as well as modularity. The invention is intended to prevent errors when changing hoses and at the same time to simplify this step so that the hose can be changed by the standard or trained operator. Thus, a costly and time-consuming service call is eliminated.

The present invention provides a peristaltic pump, comprising a motor with a motor shaft and a cassette with a rotor that is connected to the motor, wherein the rotor comprises a plurality of rollers, wherein at least one tube which surrounds the rotor partially is located between the plurality of rollers and a pressure plate which is mounted to a side wall, wherein a spring is located between pressure plate and a cover for applying a force to the pressure plate against the at least one tube, wherein the pressure plate comprises guiding ribs located on the inner surface of the pressure plate facing the at least one tube and the guiding ribs are located on both sides of the at least one tube, characterised in that the at least one tube is connected with a first end to a first vertical tube connector of a first external connector on one side of the rotor and with a second end to a second vertical tube connector of a second external connector on the opposite side of the rotor, wherein first and second vertical tube connector of the external connectors are connected to a connecting tube of a bridge providing at least one outlet, wherein the bridge comprises on their outer ends protrusions as connecting elements which engage into recesses of a side wall plate of the side wall.

Another aspect of a peristaltic pump according to the present disclosure relates to the cassette comprising a maximum of up to three tubes which are located next to each other and separated by the guiding ribs of the pressure plate.

In another embodiment of a peristaltic pump according to the present disclosure, each bridge is configured to engage into the side walls on both sides of the rotor.

It is further envisaged that the cover comprises a locking lever configured to engage with hooks arranged on top of each side wall by rotating the locking lever.

In an embodiment, the peristaltic pump comprises a locking lever which is configured in a manner that it can only be rotated in a closed position when the protrusions of the bridge correctly engage with the recesses of the side walls.

Another embodiment of a peristaltic pump provides a bridge with a grip which is arranged to extend from the bridge on the opposite side of the rotor.

The vertical tube connectors of the external connectors join in a horizontal collector tube in a peristaltic pump according to the present invention.

The peristaltic pump may comprise an external collector that comprises a maximum of three downwards projecting outlets.

The three cassettes of a peristaltic pump according to the present invention can be attached to another by bayonet couplings and the motor shaft is extended, wherein the motor shaft may comprise on its end cross-shaped couplings for their connection.

The peristaltic pump may further comprise at least two attached cassettes to the motor, wherein a gearing is arranged between the at least two cassettes.

In an embodiment of the peristaltic pump, the pressure plate comprises on both sides extension for engaging into vertical slots in each side wall for vertically aligning and guiding the pressure plate.

It is further envisaged for a peristaltic pump of the present disclosure, that each side wall comprises outer hooks for engaging into the openings of each one of the two circular guiding components.

In a further embodiment of the peristaltic pump, the locking lever comprises two circular slits and the cover comprises two inner hooks for engaging into the two circular slits of the cover.

Still other aspects, features, and advantages of the present invention are readily apparent from the following detailed description, simply by illustrating preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description or may be learned by practice of the invention.

BRIEF DESCRIPTION OF THE FIGURES

The invention will be described based on figures. It will be understood that the embodiments and aspects of the invention described in the figures are only examples and do not limit the protective scope of the claims in any way. The invention is defined by the claims and their equivalents. It will be understood that features of one aspect or embodiment of the invention can be combined with a feature of a different aspect or aspects of other embodiments of the invention, in which:

DETAILED DESCRIPTION OF THE DISCLOSURE

Figure 1:
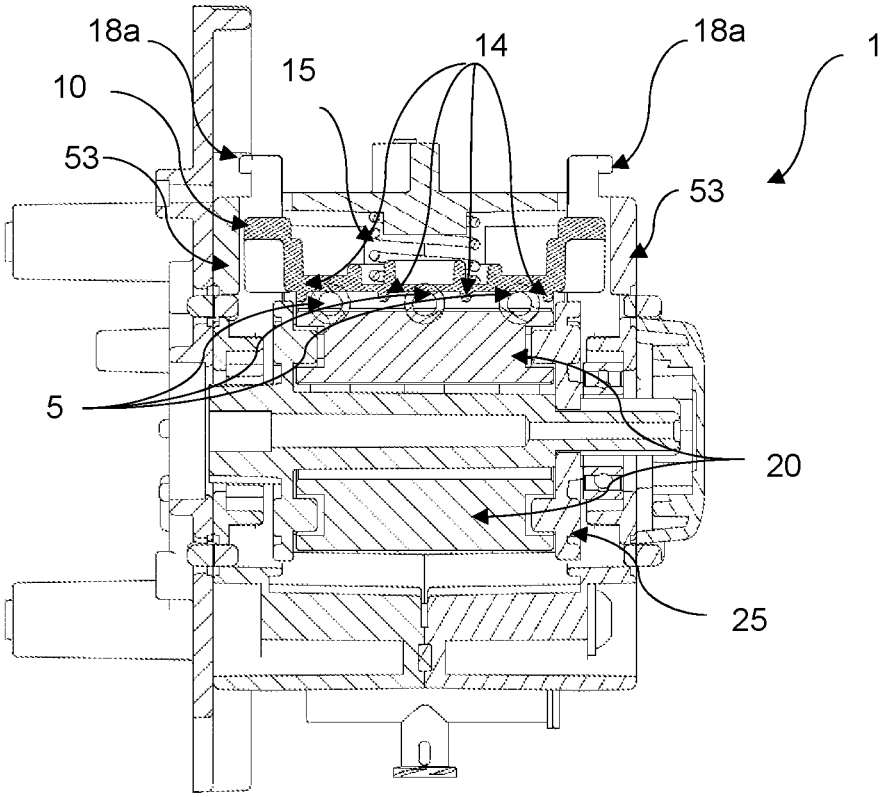
FIG. 1 shows a sectional view through a peristaltic pump with tubes which are separated from another by guiding ribs.

The technical problem is solved by the independent claims. The dependent claims cover further specific embodiments of the invention.

The terms tube and hose are used synonymously. The term fluid comprises liquids and gasses which may comprise solids.

The present invention is based on the use of a peristaltic pump for handling liquid waste as described above without causing damage or impairing performance of the system. One important element of the present invention is the peristaltic tube, which forms chambers by constrictions. These chambers are moved along the hose by peristalsis and thus generate the flow. The pump does not need any further flow-directing elements such as switch-over or non-return valves. The peristaltic hose, as a wearing element, can be replaced regularly.

In addition to the above-mentioned advantages, there are also some design-related disadvantages of the solutions from the prior art which are solved by the present invention in order to convey the problematic liquids occurring in analytical systems in a process-safe manner.

The peristaltic tube is subject to an increased wear in addition to the usual mechanical wear of a pump mechanism, caused by:

- Abrasion on the inner cross-section of the hose due to the peristaltic movements.
- Abrasion on the outside of the hose to the rollers of the rotor which generate the peristaltic movement on the hose.
- Abrasion on the outside of the hose towards the pressure surface.
- Abrasion due to the relative movement when two hoses arranged next to each other touch inside the pumping chamber.

A device according to the present invention provides guiding ribs that at the surface of a pressure plate directed towards the tubes for preventing the peristaltic tubes from moving sideways and thus from touching neighbouring tubes. Thus, the tubes are properly positioned for preventing any collisions between neighbouring tubes. The pressure plate is spring-mounted. The contact pressure between pressure plate and hoses is configured for ensuring a safe, backflow-proof operation. At the same time, however, the contact pressure is configured that the hose is sufficiently squeezed by the rollers, so that the inner contour is just completely closed. The pressure has to be adjusted that it is not too low, so that the hose is not completely closed, and the pump performance deteriorates, and the pump is no longer backflow-proof. On the other hand, if the pressure is too high, the wear of the hose increases. In essence, the pressure is depending on the properties of the hose with respect to its diameter, material, the thickness of the walls etc. Thus, the pressure is adjusted to the minimal required contact pressure so that the rollers will close the hose completely during pressing it to the pressure plate.

A device according to the present disclosure does not comprise flow direction indicating elements such as change-over or non-return valves. A backflow resistance is solely generated by the sealing fit of the compressed peristaltic tube. This contact pressure is generated by a helical spring. The force is transmitted to an upper pressure plate which finally presses the peristaltic tubes onto the rotor or the pressure rollers, respectively, underneath.

In addition to reducing the wear, the spring-loaded upper pressure plate is related to further advantages: The nominal flow rate of a peristaltic pump is determined by the speed, the number of rotors and the internal cross-section of the peristaltic tube. The latter add up to the volume that can be pumped per revolution. The contact pressure has also an influence on the delivery rate. By using a helical spring as the element that causes the contact pressure, the contact pressure on the peristaltic tube can be kept constant by selecting a spring with a suitable spring characteristic curve, even if its dimensions vary within the usual production tolerances. It will also be possible to compensate manufacturing and assembly-related tolerances via this mechanism.

A device according to the present disclosure provides further a higher flexibility of the pump in analysis systems. Depending on the system, the number of required channels and the flow rates per channel may change. In principle, several channels or pumps can be combined in all common peristaltic pumps in order to multiply the flow rate. However, this increases the complexity of the peripheral tubing.

In the present invention, the number of channels of the pump can be configured arbitrarily between 1 to 9 channels with a maximum of three so-called cassettes with three tubes in each cassette. A single cassette can hold between 1 to 3 channels, i.e. peristaltic tubes. Thus, a maximum of three pumps (cassettes) are driven by one motor. The connection between the side walls of adjacent cassettes is made via a bayonet lock, which is additionally secured against rotation by means of a screw.

The motor shaft is connected via a cross-shaped coupling which is male on one side and female on the other side. Within a cassette, this axle is only supported on the output side (away from the motor), the input side support is provided by the output side support of the previous cassette, or in the case of the first cassette, by the motor.

To reduce the complexity of the peripheral tubing and to save installation space, it is possible to combine all channels per cassette. Conversely, it is also possible to distribute from one common channel to three channels. Thus, for example, up to nine individual channels can be extracted. Only three channels must be discharged on the pressure side. It is also possible to combine the channels on the suction and pressure sides. This means that three channels can be used in parallel, which also triples the volume flow.

If only one tube is used in a cassette, a lower contact pressure is necessary, which is the reason for adjusting or reducing the spring force of the contact plate in this case. The cassettes of this alternative (cover, tube kit, cassette side wall) are color-coded for a better differentiation and thus for reducing assembly errors (for instance: green=cassette for one tube, black=cassette for two and three tubes).

Furthermore, the speed of the following cassettes can be reduced by a ratio of 1:3 via a gear stage between two cassettes. Using a suitable channel configuration, ratios between 1:1 and 1:10 can be achieved. This means that the pump is also capable of producing mixing ratios beyond its pure application as a suction pump.

The device according to the present disclosure is not only directed to merely solve technical disadvantages but for solving disadvantages of known devices regarding the user interface. The present invention is intended to enable a trained user to independently replace the peristaltic tube as a wearing element within the scope of the usual maintenance intervals.

Currently available peristaltic pumps are related to the following discussed faults that can occur due to incorrect operation.

A problem may result from a peristaltic hose which is not correctly installed when it is replaced. This leads to an undefined contact pressure between the roller and the hose and thus to an undefined delivery volume and a pump that may not be resistant to backflow. It is possible that the pump still functions normally directly after the hose package has been replaced and only loses its function afterwards.

The present invention solves this first problem by having latching elements formed by a protrusion which engages into a recess at both attachment points (external connector) for the tube assembly, which initially provide haptic feedback for a correct installation of the tube.

A further problem in devices known from the prior art may result from a cover that is not correctly mounted or closed. As a result, the correct contact pressure will not be generated on the peristaltic tubes and the pump does thus not work correctly and/or is no longer non-refluxing. In this case, it is also conceivable that the pump still functions correctly initially and only gradually loses its function.

The pump according to the present disclosure has a central locking element, a locking lever, for avoiding this condition. Such a locking lever allows basically only two states, open and closed. If the cover is closed, the locking lever is in a perceivable closed position and full pressure is applied to the peristaltic tubes and the pump works correctly. If the locking lever is in a perceivable open position, the pump does not deliver any liquid at all. Closed and open position of the locking lever can be distinguished by its angle with respect to the side walls of the housing. A loss in pressure can additionally be detected more easily by a downstream sensor system as an incorrect flow rate. The locking lever of the bayonet lock of a device according to the present disclosure has roughened grip surfaces and pictograms (open and closed lock) for a simple and more intuitive operation.

In addition to the purely mechanical issues mentioned above, there are also solutions in the field of electronics or embedded software which will be discussed below.

The peristaltic pump is driven by a stepper motor. The drive torque can be adjusted via the current intensity. The revolutions are monitored via a home sensor. This results in the following advantages:

Overload protection and conveying process monitoring: An initialisation position is determined by the home sensor. The stepper motor can be used to count the number of steps it takes to reach the home sensor position again. A drive torque is predefined via the current intensity. If the motor does not reach the home position, an error is output, and the pump stops operating. This could be the case, for example, if the resistance torque exceeds the drive torque due to a mechanical defect or a pressure-side blockage of the fluidic periphery.

Avoidance of a memory effect in the peristaltic tube: If the drive of the pump always runs full revolutions (360°), this would mean that the rollers of the rotor would always be engaged in the same position of the peristaltic tube at standstill. Since the hose is an elastomer, it is also subject to the usual properties of the material. In the case of a constant, local pressure load, the material would be permanently deformed. For the inner cross-section, this would mean a permanent reduction. This in turn would have an effect on the delivery rate of the pump. To counteract this form of ageing, the stepper motor basically rotates through the 360° equivalent of steps plus one additional step. This distributes the local pressure load on the peristaltic tube over as large an area as possible.

Predictive maintenance of the peristaltic tubes and pump mechanics: The embedded software carries out checks at regular intervals. During these checks, the current of the motor is gradually reduced until a loss of step can be detected. This allows changes in the mechanical system to be detected. These changes in turn result from wear in the pump mechanics, but mainly from wear of the hose. By constantly recording this current value over time in connection with suitable machine learning algorithms, a failure of the peristaltic tube as a maintenance part as well as a failure of the entire module can be predicted. In this way, timely maintenance can be initiated, and the downtime of the entire system can be reduced.

FIG. 1 shows a sectional view through a peristaltic pump 1 with tubes 5 which are separated from another by guiding ribs 14. Tubes 5 are pressed against roller 20 of the rotor 25 by pressure plate 10. A helical spring 15 provides a constant pressure of pressure plate 10 against tubes 5. Outer hooks 18*a* are arranged on top of side walls 53.

Figure 2:
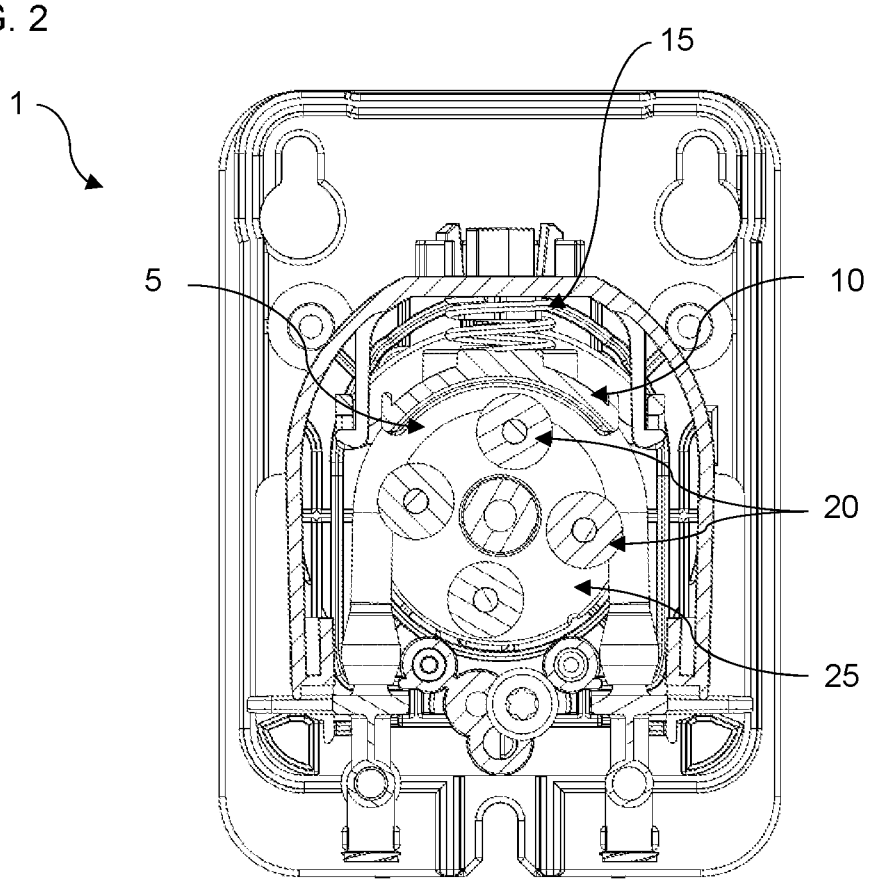
FIG. 2 shows a sectional view through a peristaltic pump.

FIG. 2 shows a sectional view through a peristaltic pump 1, wherein the sectional plane is rotated by 90° in comparison to FIG. 1. The rotor 25 carries four rollers 20 in the shown embodiment. Pressure plate 10 is pressed by the force of helical spring 15 against tube 5.

Figure 3:
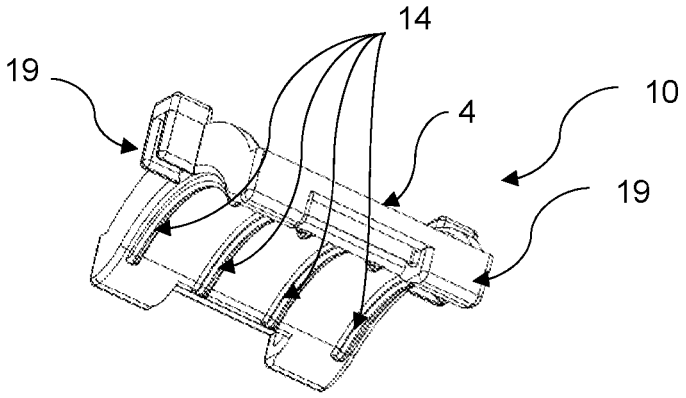
FIG. 3 shows a pressure plate with guiding ribs.
Figure 5:
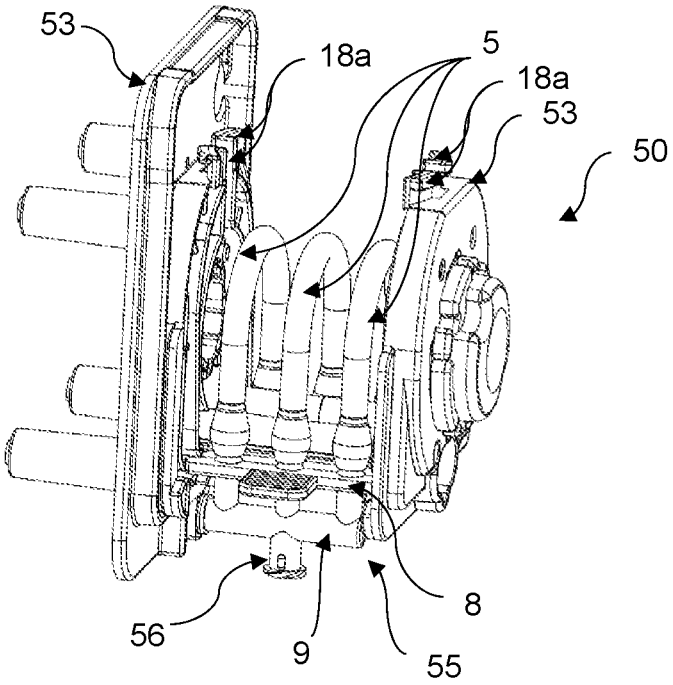
FIG. 5 shows a cassette comprising three tubes and an external connector with a single outlet.
Figure 13:
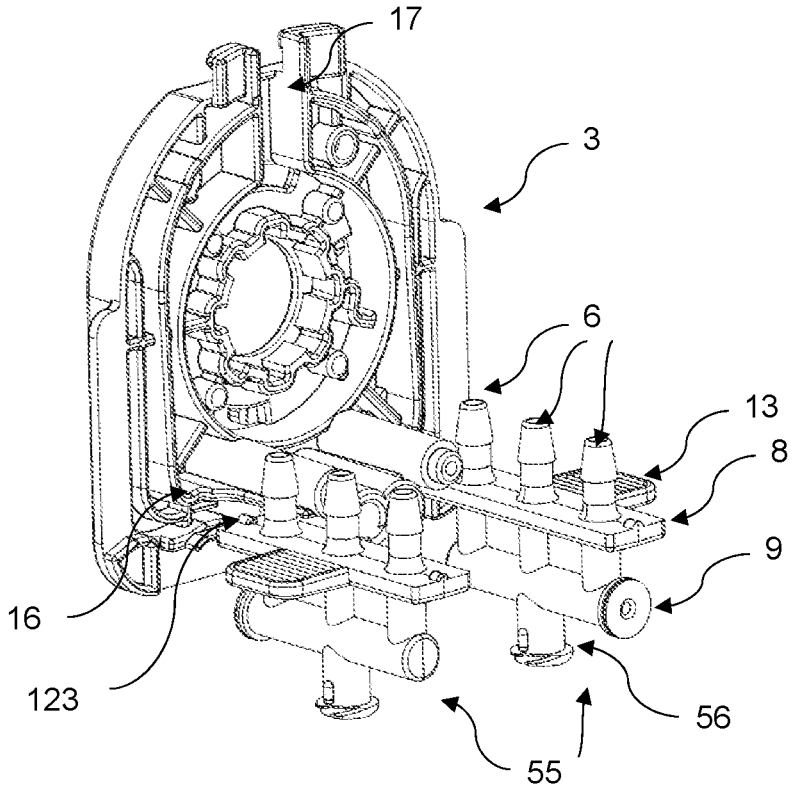
FIG. 13 shows a perspective view onto a side wall plate for attaching external connectors.

FIG. 3 shows a pressure plate 10 with guiding ribs 14. In the shown embodiment, Extensions 19 extend on both sides from pressure plate 10 and engage in slots 17 (comp. FIG. 13) arranged in each side wall 53 for a vertical alignment and guidance of spring-loaded pressure plate 10 applying pressure onto at least one tube 5 (comp. FIG. 5)

Figure 4:
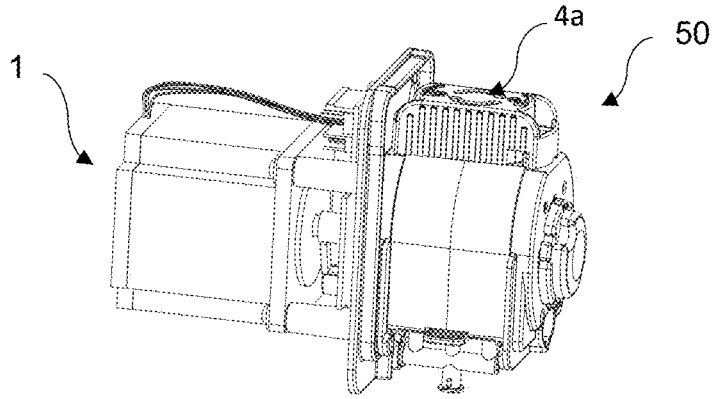
FIG. 4A shows a peristaltic pump comprising one cassette.
FIG. 4B shows a peristaltic pump comprising two cassettes.
FIG. 4C shows a peristaltic pump comprising three cassettes.
Figure 4:
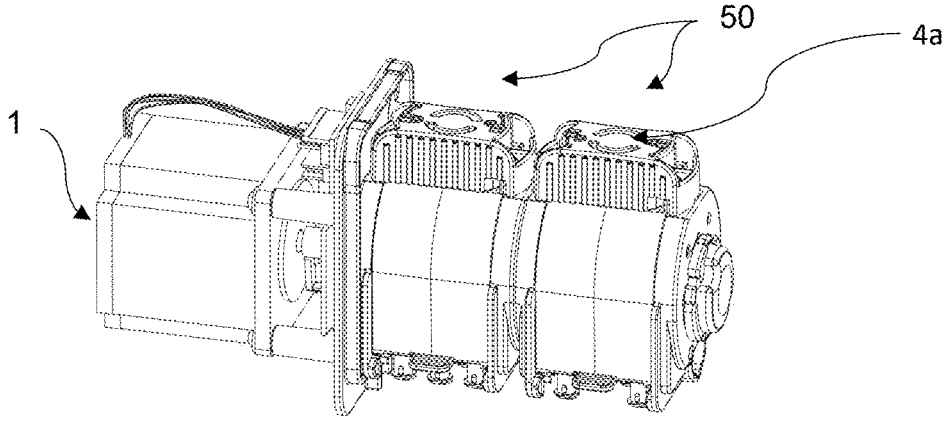
Figure 4:
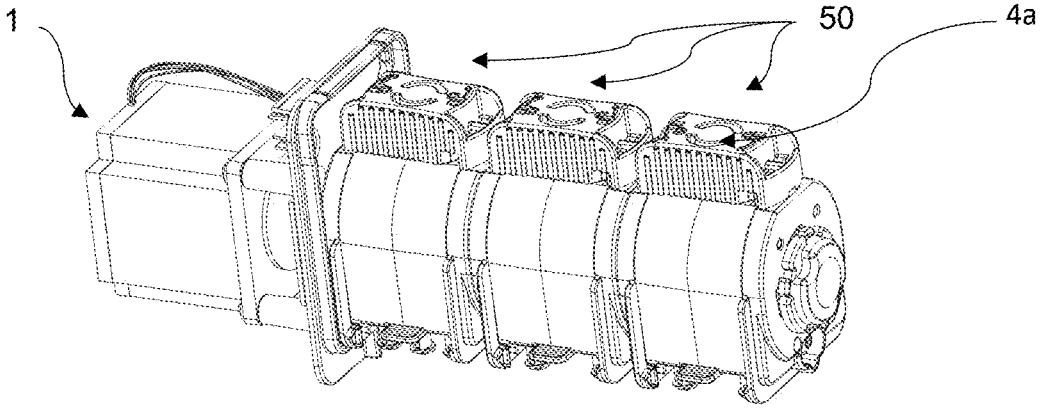

FIG. 4A shows a peristaltic pump 1 with an attached cassette 50 with a correctly mounted cover 12. FIG. 4B shows a peristaltic pump 1 with two attached cassettes 50 with two correctly mounted covers 12 and FIG. 4C shows a peristaltic pump 1 with three attached cassettes 50 with correctly mounted covers 12.

Turning to FIG. 4B, the locking levers 4 of each cover 12 are fully rotated indicating that they are in a closed position. Outer hooks 18*a* engage in a circular guiding component 4*a* of locking lever 4, wherein the guiding provides opening 3 on one side for introducing outer hooks 18*a* and the circular guiding component 4*a* is closed on the other side so that locking lever 4 can be rotated until outer hooks 18*a* will be stopped by the closed side of the circular guiding component 4*a* for securely closing the cassette 50. The closed side of the circular guiding component 4*a* has the function of a stop. A rotation of locking lever 4 is only possible, when the hooks are fully introduced into the circular guiding component 4*a* of the locking lever 4. Further, not gap is visible at the lower end of the cover 12, so that covers 12 are obviously correctly mounted to cassette 50.

FIG. 5 shows an open cassette 50 without cover comprising three tubes 5 connected to an external connector 55 with a single outlet 56. The liquids are distributed by tube connector 9 of bridge 8 from the three tubes 5 to the single outlet 56. Two external connectors 55 which are connected by at least one tube are provided as a tube kit. The tube kits can be adapted to the requirements of the peristaltic pump regarding the number of tubes-up to three per cassette—and regarding the number of outlets.

Figure 9:
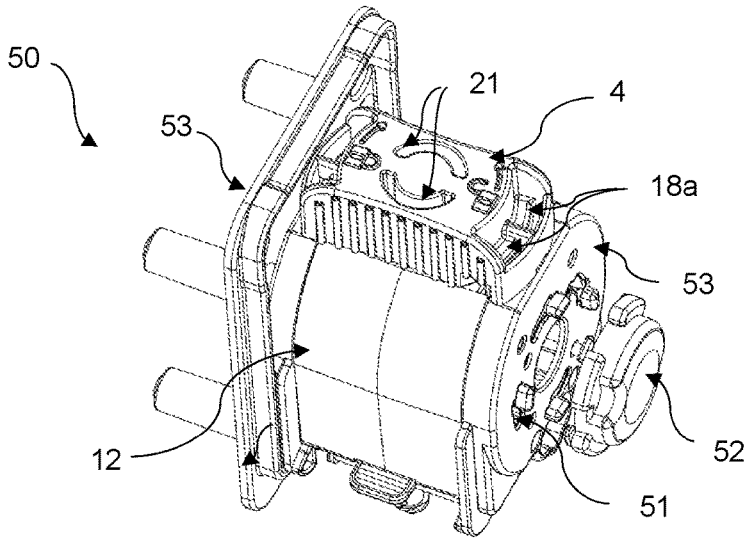
FIG. 9 shows a perspective view onto a cassette with bayonet connector for a cap.

The housing of cassette 50 comprises two side walls 53. Outer hooks 18*a* are arranged on the upper end of side walls 53 as part of the bayonet coupling for cover 12. The embodiment in FIG. 5 comprises two pairs of outer hooks 18*a*, wherein each side wall 53 comprises one pair of hooks. The counterpart of the bayonet coupling is locking lever 4 of cover 12 which is rotatably mounted to cover 12 so that locking lever 4 can engage with outer hooks 18*a* (comp. FIG. 9) which can have a L-form for example.

Figure 6:
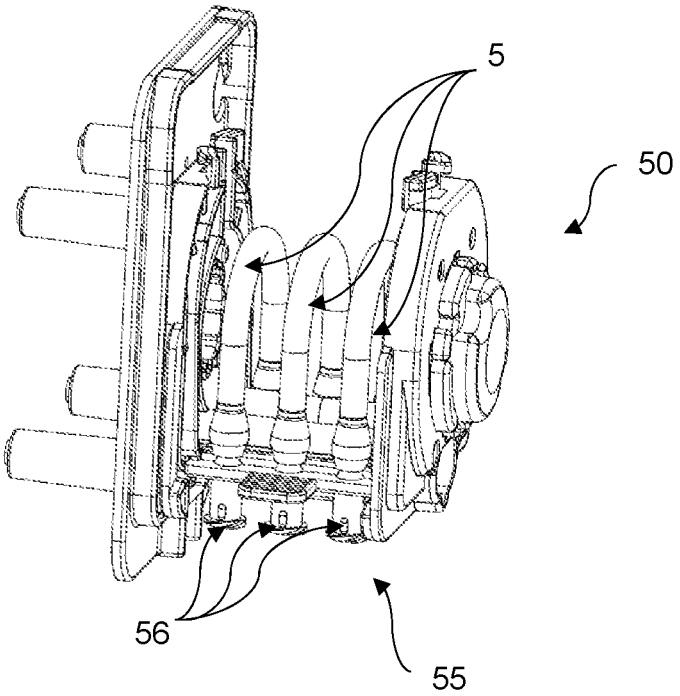
FIG. 6 an embodiment of a cassette with three tubes and an external connector with three outlets.

FIG. 6 shows an embodiment of an open cassette 50 without cover with three tubes 5. Each tube 5 is coupled to the external connectors 55 providing a separate outlet 56 for each tube 5.

Figure 7:
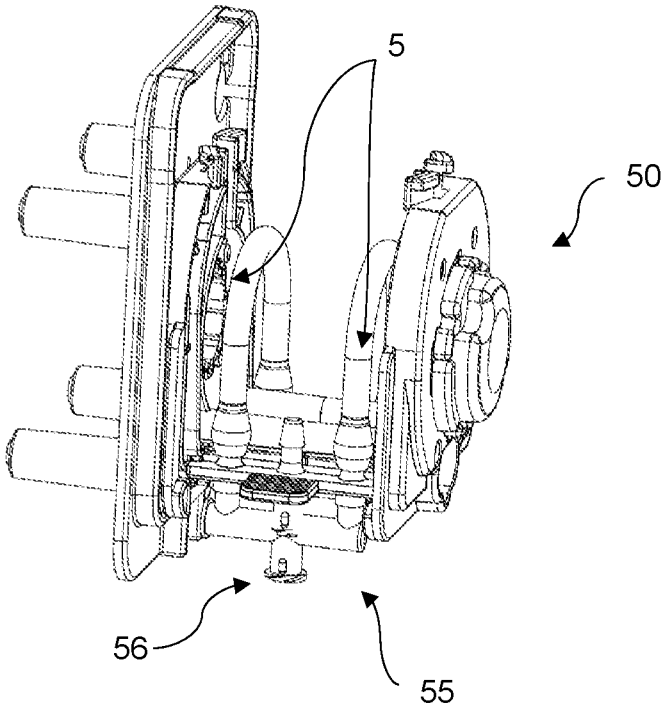
FIG. 7 shows an embodiment of a cassette with two tubes and an external connector with a single outlet.

FIG. 7 shows an embodiment of a cassette 50 with two tubes 5 and a single external connector 55 with a single outlet 56. The middle tube connector 6 is closed so that no liquid will leak.

Figure 8:
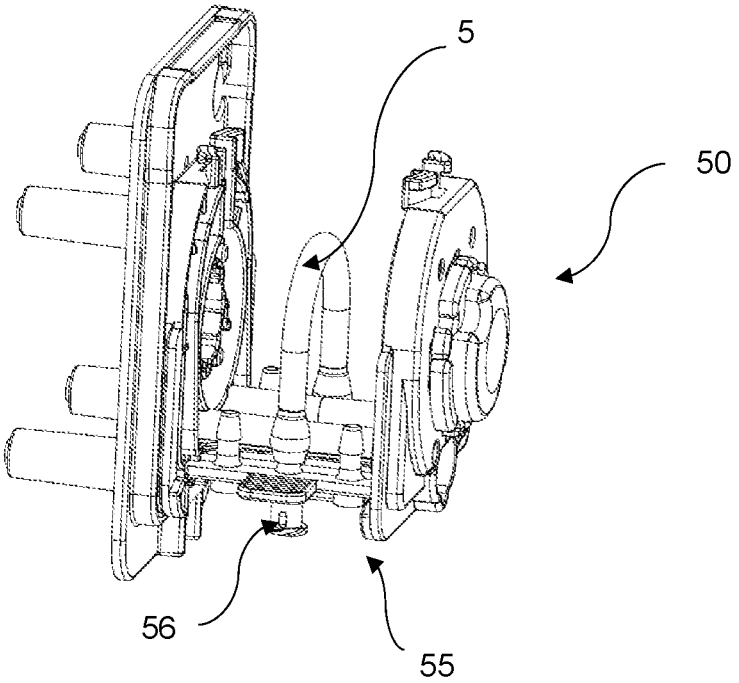
FIG. 8 an embodiment of a cassette with a single tube and an external connector with a single outlet.

FIG. 8 shows an embodiment of a cassette 50 with a single tube 5 connected to an external connector 55 with a single outlet 56. The two outer tubes are missing and consequently the external connector 55 does not provide the possibility to connect tubes at the two outer positions.

FIG. 9 shows a perspective view onto a cassette 50 with bayonet connector 51 for attaching further cassettes or a cap 52. Locking lever 4 is in a closed position indicating that cover 4 is correctly closed. In an embodiment, a closed position of locking lever 4 is characterised by a perpendicular orientation to side walls 53. Locking lever 4 is engages with outer hooks 18*a*.

Figure 10:
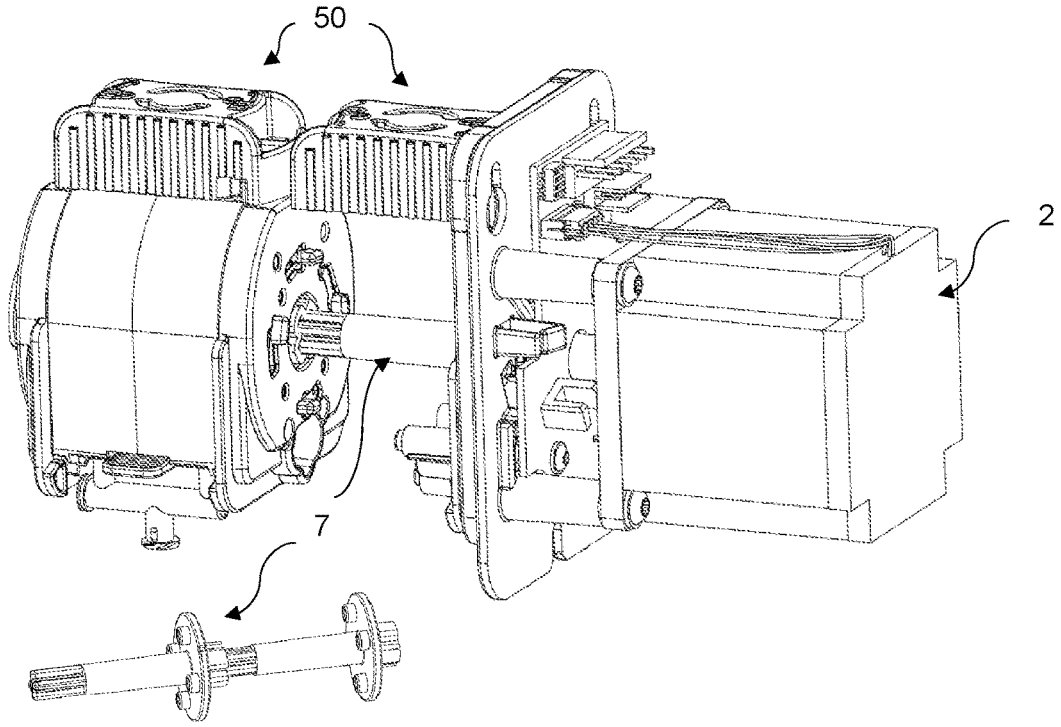
FIG. 10 shows a motor with two cassettes, wherein the inner cassette is blanked for showing the connecting axis.

FIG. 10 shows in its upper right part a motor 2 with is coupled to two cassettes 50, wherein the side wall 53 of the cassette 50 next to the motor 2 is blanked out so that motor shaft 7 becomes visible which connects the motor shaft 7 of neighbouring cassettes 50 by a cross-shaped coupling also to the rotary axis of the motor 2. The lower part of FIG. 10 shows two connected motor shaft 7 in more detail.

Figure 11:
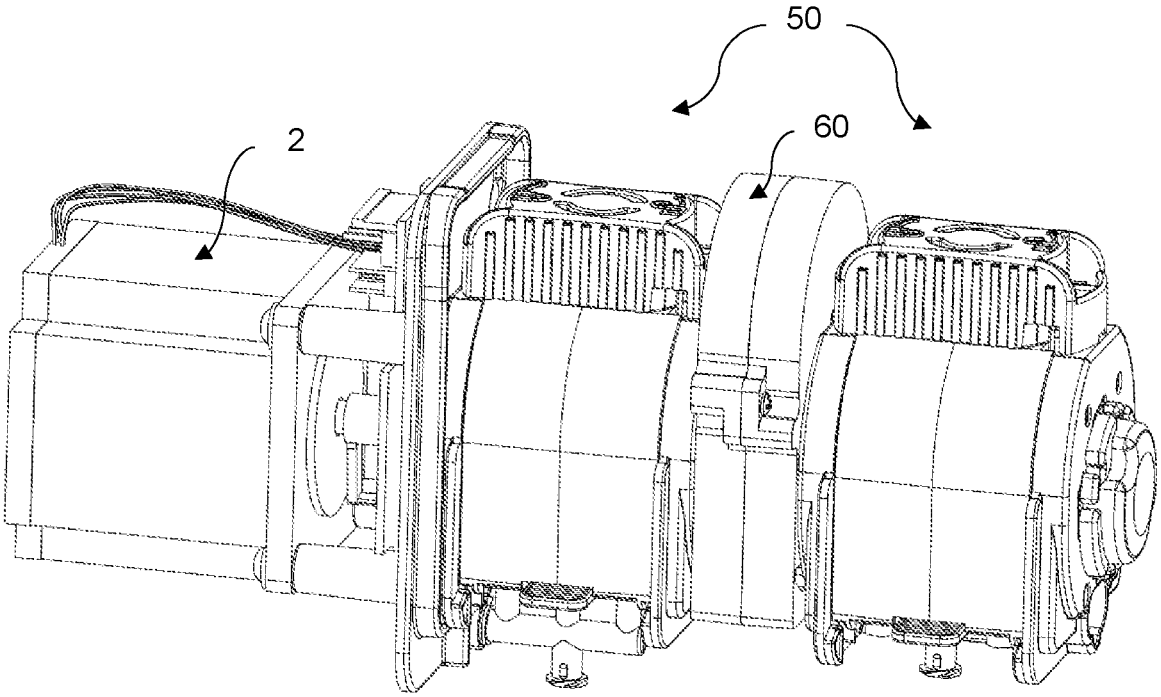
FIG. 11 shows the complete arrangement of motor with two attached cassettes and a gearbox located between the two cassettes.

FIG. 11 shows the complete arrangement of a peristaltic pump 1 with two closed cassettes 50 attached to the motor 2 and a gearbox 60 located between the two cassettes 50. The gearbox 60 may be used to reduce the speed between neighbouring cassettes 50 in a defined ratio, which may be for instance in a range between 1:1 to 1:10.

Figure 12:
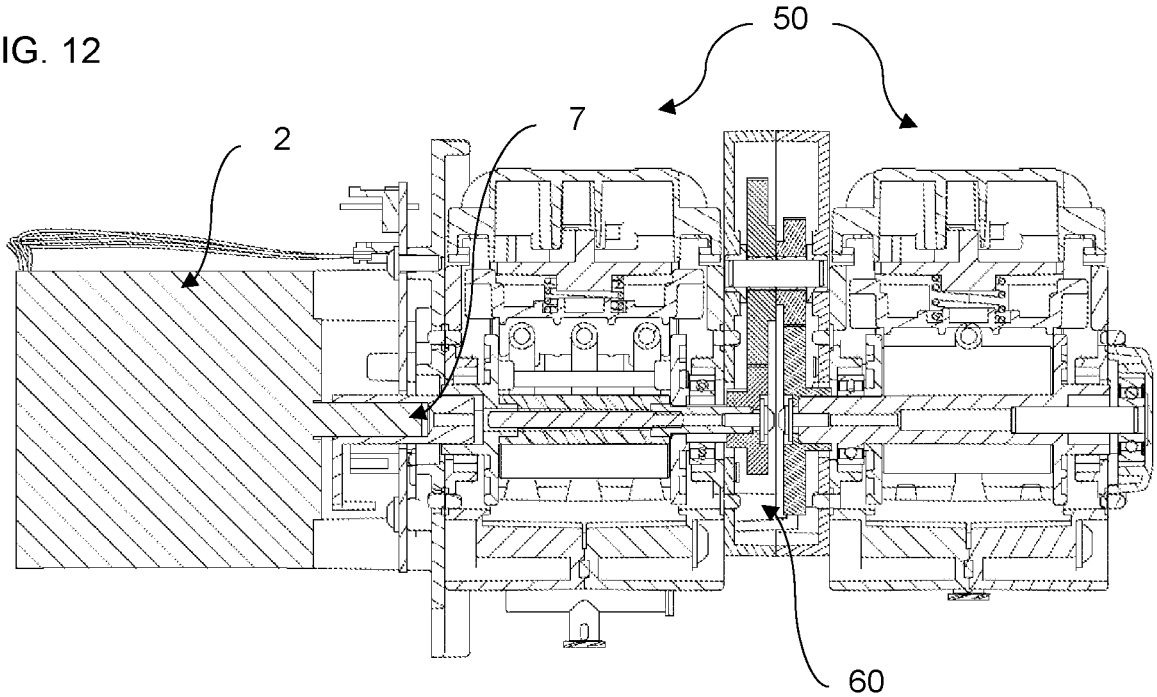
FIG. 12 shows a sectional view through a motor and two cassettes which are attached to the motor and a gearbox between the two cassettes.

FIG. 12 shows a sectional view through a motor 2 with motor shaft 7 and two cassettes 50 which are attached to motor shaft 7 and a gearbox 60 which is arranged between the two cassettes 50.

FIG. 13 shows a perspective view onto a side wall 53 belonging to the housing of a cassette or attaching external connectors 55 and cover 12 (not shown). On its upper end, the external connector 55 provides three tube connectors 6 which are located above connecting tube 9 of bridge 8, wherein the tube connectors 6 extend downwards into the horizontal collector tube 9 of bridge 8. The external connector 55 in FIG. 13 provides a single outlet 56 extending substantially downwards from the horizontal collector tube 9. A bridge 8 provides outwardly directed grips 13 for their handling. The ends of bridge 8 further comprise on their outer ends protrusions as connecting elements 123 which engage into recesses 16 of side wall plate 3 for the of the external connectors 55.

Figure 14:
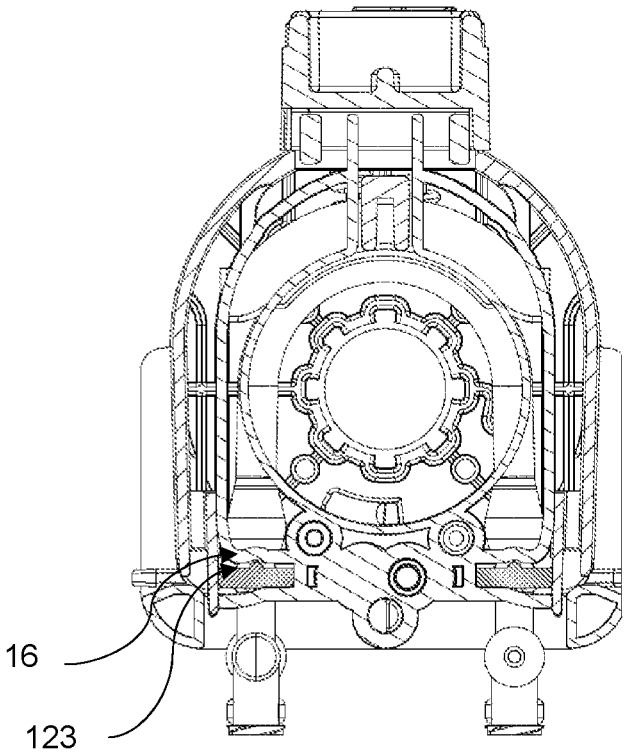
FIG. 14 shows a sectional view through a side wall plate with external connectors as shown in FIG. 13

FIG. 14 shows a sectional view through a side wall 53 with external connectors 55 as shown in FIG. 13, where the interaction between the protrusions of connecting elements 123 and recesses 16 of the side wall plate can be seen in more detail.

Figure 15:
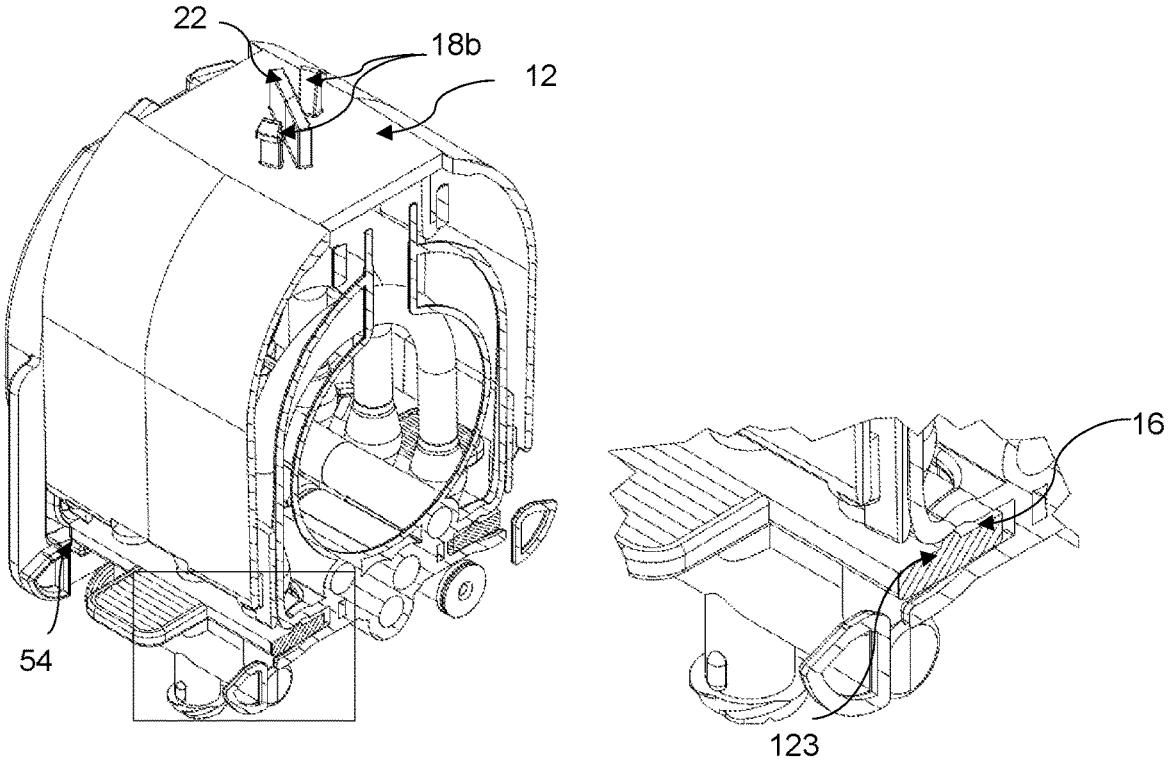
FIG. 15 shows the interaction between a side wall cover and the connecting elements of a bridge.

FIG. 15 shows in more detail that cover 12 is not correctly fixed by engaging into gap 54 in the lower part of side wall 53, when the external connectors 55 has not been fitted correctly by inserting the protrusions as connecting elements 123 into recesses 16 of the side wall plate 53. Thus, the required connection between the connecting elements 123 and recesses 16 can be regarded as safety features for a correct assembly of a cassette with the external connectors, because the correct interaction between the protrusions of connecting elements 123 and the recesses are a prerequisite for the possibility to fix the cover in gaps 54 of side walls 53.

Figure 16:
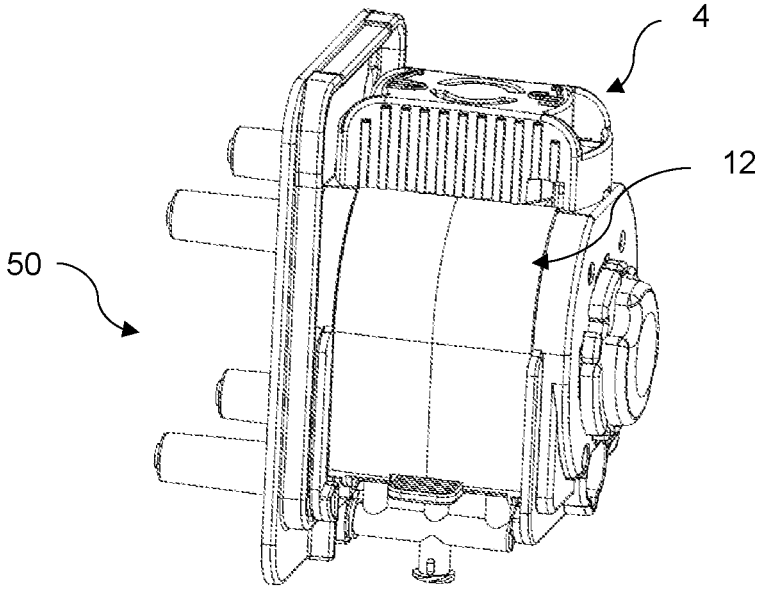
FIG. 16 shows a correctly locked side wall cover of a cassette.

Locking lever 4 of cover 12 is missing in FIG. 15 so that inner hooks 18*b* are visible, which engage in slits 21 of locking lever 4 (comp. FIG. 16). Inner stop 22 limits the rotational motion on locking lever 4 when it is rotated into an open position.

FIG. 16 shows an embodiment of a cassette 50 with a correctly mounted cover 12 resulting in a l locking lever 4 which is perceivable in a closed position.

Figure 17:
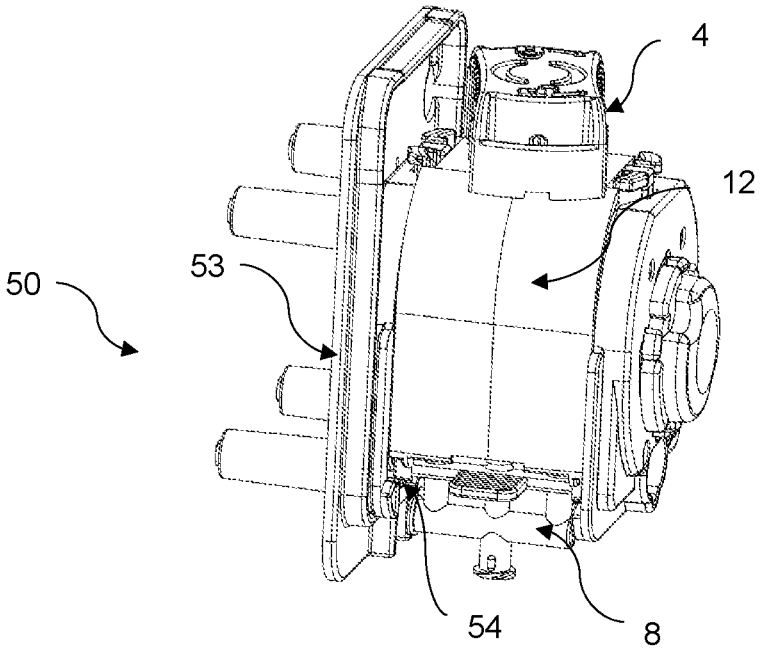
FIG. 17 shows an unfixed side wall cover with lockable locking lever.

FIG. 17 shows an embodiment of a cassette 50 with a cover 12 which is not correctly locked so that no pressure will be applied to the tubes, resulting in a loss of functionality of the peristaltic pump. Cover 12 is not fitted into gap 54 of side walls 53. Additionally, locking lever 4 is arranged with an offset of 45° with respect to side walls 53 so that a user can easily realize that the cover 12 is not correctly closed.

Figure 18:
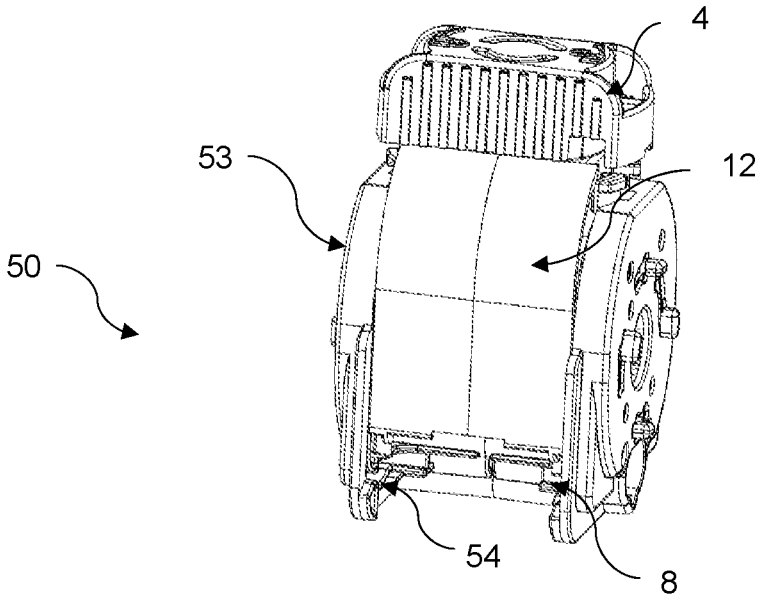
FIG. 18 shows a locked locking lever with a not correctly applied side wall cover.

FIG. 18 shows a cassette 50 with a locking lever 4 in a closed position, but it is visible that cover 12 is not engaged in gaps 54 of side walls 53 so that it can easily be perceived that the cover 12 is not mounted correctly and a loss of function will result. In addition to the position of locking lever 4 or the gap at the lower side of cover 12, the pump will not work correctly within the meaning of applying the expected pressure to the tubes so that the device according to the present invention provides three features which will directly make a user aware of the fact that the device is not in an operation mode.

Figure 19:
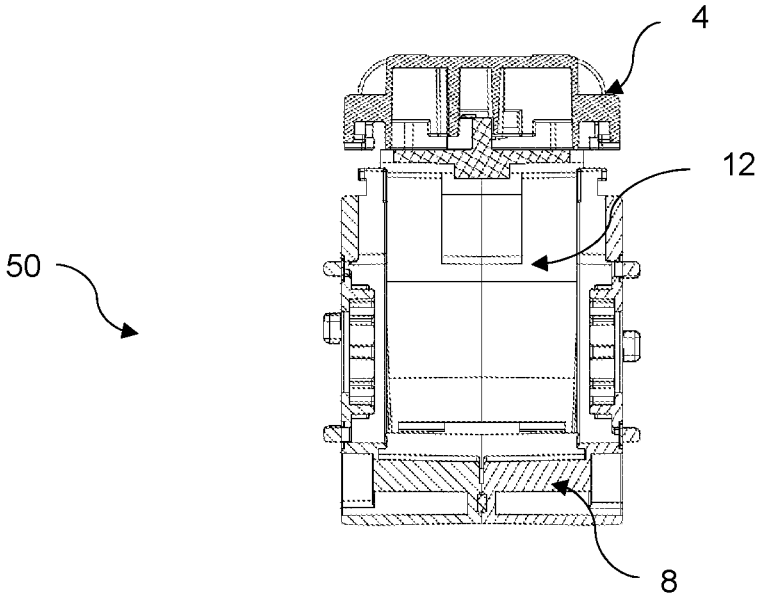
FIG. 19 shows a sectional view through the depiction of FIG. 18.

FIG. 19 shows a sectional view through the assembly shown in FIG. 18.

The advantages of a device according to the present invention can be summarised as follows:

- a reduced wear due to spring-loaded pressure plate;
- a reduced wear due to guide ribs on the pressure plate;
- a compensation of production-related tolerances through spring-loaded pressure plate;
- providing a tube kit comprising at least one tube and two external connectors with protrusions as connecting elements and corresponding recesses in side wall plates reduces the risk of not fixing the tube correctly to the side wall plates of the cassette;
- a clear indication of the side wall with pressure plate when it is not correctly fixed by a gap or a not completely rotated locking lever reduces the risk of incorrectly mounting the side wall to the cassette; and
- a high variability due to:
  - i. number of mounted cassettes can be adapted;
  - ii. number of tubes (channels) per cassette can be adapted;
  - iii. combining or distributing of or to up to three tubes (channels) per tube kit; and
  - iv. reduction of the speed between two cassettes by means of a gear stage;
- operation monitoring by step counting; and
- predeterminable maintenance intervals.

The foregoing description of the preferred embodiment of the invention has been presented for purposes of illustration and description. It is not intended to be exhaustive or to limit the invention to the precise form disclosed, and modifications and variations are possible considering the above teachings or may be acquired from practice of the invention. The embodiment was chosen and described to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

REFERENCE NUMERALS

1 peristaltic pump
2 motor
3 opening
4 locking lever
4*a* circular guiding component
5 tube
6 tube connector
7 motor shaft
8 bridge
9 collector tube
10 pressure plate
11 connecting tube
12 cover
13 grip
14 guiding rib
15 helical spring
16 recess
17 slot
18*a* outer hooks
18*b* inner hooks
19 extension
20 roller
21 slit
22 inner stop
25 rotor
50 cassette
51 bayonet coupling
52 cap
53 side wall
54 gap
55 external connector
56 outlet
60 gearbox
123 connecting element

We claim:

1. A peristaltic pump comprising:

a motor with a motor shaft; and a cassette with a rotor that is connected to the motor shaft, wherein the rotor comprises a plurality of rollers, wherein at least one tube which surrounds the rotor partially is located between the plurality of rollers and a pressure plate which is mounted to one of two side walls, wherein a spring is located between the pressure plate and a cover for applying a force to the pressure plate against the at least one tube, wherein the cover comprises a locking lever configured to engage with outer hooks arranged on top of each side wall by rotating the locking lever and wherein the pressure plate comprises guiding ribs located on the inner surface of the pressure plate facing the at least one tube and the guiding ribs are located on both sides of the at least one tube, characterised in that the at least one tube is connected with a first end to a first vertical tube connector of a first external connector on one side of the rotor and with a second end to a second vertical tube connector of a second external connector on the opposite side of the rotor, wherein the first and second vertical tube connector of the external connectors are connected to a connecting tube of a bridge providing at least one outlet, wherein the bridge comprises on its outer ends protrusions as connecting elements which engage into recesses of a side wall plate of the side wall, wherein the bridge is configured to engage into the side walls on both sides of the rotor and the locking lever is configured to rotate in a closed position only when the protrusions of the bridge engage with the recesses of the side walls.

2. The peristaltic pump of claim 1, wherein the cassette comprises a maximum of up to three tubes which are located next to each other and separated by the guiding ribs of the pressure plate.

3. The peristaltic pump of claim 1, wherein the pressure plate comprises on both sides an extension for engaging into vertical slots in each side wall for vertically aligning and guiding the pressure plate.

4. The peristaltic pump of claim 3, wherein the bridge comprises a grip which is arranged to extend from the bridge on the opposite side of the rotor.

5. The peristaltic pump of claim 1, wherein the vertical tube connectors of the external connectors join into a horizontal collector tube.

6. The peristaltic pump of claim 5, wherein the first external collector comprises a maximum of three downwards projecting outlets.

7. The peristaltic pump of claim 1, wherein up to three cassettes are attached to one another by bayonet couplings and the motor shaft is extended.

8. The peristaltic pump of claim 7, wherein the motor shaft comprises on its end cross-shaped couplings for its extension.

9. The peristaltic pump of claim 1, comprising at least two cassettes attached to the motor, wherein a gearing is arranged between the at least two cassettes.

10. The peristaltic pump of claim 1, wherein the locking lever comprises two circular guiding components on each side.

11. The peristaltic pump of claim 10, wherein each circular guiding component is open on one end and closed on the opposite end.

12. The peristaltic pump of claim 10, wherein each side wall's outer hooks engage into openings of the respective two circular guiding components.

13. The peristaltic pump of claim 1, wherein the locking lever comprises two circular slits and the cover comprises two inner hooks for engaging into the two circular slits of the locking lever.

* * * * *